US007325526B2

(12) United States Patent
Kawamoto

(10) Patent No.: US 7,325,526 B2
(45) Date of Patent: Feb. 5, 2008

(54) FOUR-STROKE ENGINE SYSTEM

(75) Inventor: Shiro Kawamoto, Texarkana, AR (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 0 days.

(21) Appl. No.: 10/719,148

(22) Filed: Nov. 21, 2003

(65) Prior Publication Data

US 2005/0109307 A1 May 26, 2005

(51) Int. Cl.
*F01M 9/06* (2006.01)

(52) U.S. Cl. ..... 123/196 R

(58) Field of Classification Search ..... 123/196 R, 123/196 W, 196 CP; 184/13.1, 11.1
See application file for complete search history.

(56) References Cited

U.S. PATENT DOCUMENTS 4,601,267 A 7/1986 Kronich
4,628,878 A 12/1986 Nakano et al.
4,732,237 A 3/1988 Nakano
4,762,098 A * 8/1988 Tamba et al. ..... 123/90.33
5,058,542 A 10/1991 Grayson et al.
5,107,808 A * 4/1992 Mahn et al. ..... 123/195 C
5,241,932 A 9/1993 Everts
5,347,967 A 9/1994 Todero et al.
5,579,735 A 12/1996 Todero et al.
5,709,185 A 1/1998 Aizawa et al.
5,738,062 A 4/1998 Everts
5,860,403 A 1/1999 Hirano et al.
5,947,075 A 9/1999 Ryu et al.
5,950,590 A 9/1999 Everts et al.
5,960,764 A 10/1999 Araki
5,975,042 A 11/1999 Aizawa et al.
6,039,020 A 3/2000 Kawamoto et al.
6,047,678 A 4/2000 Kurihara et al.
6,098,577 A * 8/2000 Wu ..... 123/41.35
6,109,251 A * 8/2000 Haberlein et al. ..... 123/572
6,119,648 A 9/2000 Araki
6,213,078 B1 4/2001 Ryu et al.
6,213,079 B1 4/2001 Watanabe
6,213,081 B1 4/2001 Ryu et al.
6,216,660 B1 4/2001 Ryu et al.
6,220,216 B1 4/2001 Häberlein
6,227,160 B1 5/2001 Kurihara et al.
6,257,192 B1 7/2001 Yamaura et al.
6,273,049 B1 * 8/2001 Okuda et al. ..... 123/195 C
6,283,084 B1 9/2001 Nagai et al.
6,332,440 B1 12/2001 Nagai et al.
6,363,904 B1 4/2002 Kurihara et al.
6,374,796 B1 4/2002 Kawamoto et al.
6,394,060 B2 5/2002 Nagai et al.
6,422,194 B2 7/2002 Ito et al.

(Continued)

*Primary Examiner*—Stephen K. Cronin
*Assistant Examiner*—Hyder Ali
(74) *Attorney, Agent, or Firm*—Pearne & Gordon LLP

(57) ABSTRACT

A four-stroke engine employs engine vibration for lubricating engine components. The engine vibration induces a ripple in a surface portion of the oil in an oil reservoir, which is located within a crankcase of the engine. The oil ripple causes misting of the oil, which lubricates exposed engine components. Providing a crankcase wall thickness of about 1.5 mm or less can increase the engine vibration. Alternatively, a clearance area located within the crankcase can be decreased to facilitate contact of the oil surface ripple with a counterweight, thereby splashing the oil onto exposed engine components. Vibration of the engine can be further increased by coupling a vibration plate or spring to a portion of the crankcase.

14 Claims, 3 Drawing Sheets

U.S. PATENT DOCUMENTS 6,494,176 B2 12/2002 Ito et al.
6,505,596 B2 1/2003 Ito et al.
6,508,224 B2 1/2003 Ito et al.
6,510,829 B2 1/2003 Ito et al.
6,546,907 B2 4/2003 Liu et al.
6,622,688 B2 9/2003 Everts et al.
6,666,184 B2 12/2003 Kurihara et al.
6,705,263 B2 3/2004 Ito et al.
6,705,271 B2 3/2004 Liu
6,745,741 B2 6/2004 Liu
6,745,742 B2 * 6/2004 Meyer ..... 123/197.3
6,769,391 B1 * 8/2004 Lee et al. ..... 123/196 R
6,772,726 B2 8/2004 Kawamoto et al.
6,786,187 B2 * 9/2004 Nagai et al. ..... 123/196 R
6,863,043 B2 3/2005 Kurihara et al.
6,945,215 B2 9/2005 Kawamoto et al.
2004/0107938 A1 6/2004 Everts et al.
2005/0109307 A1 5/2005 Kawamoto
2006/0254556 A1 11/2006 Hu

* cited by examiner

FOUR-STROKE ENGINE SYSTEM

FIELD OF THE INVENTION

The present invention relates to a four-stroke engine, and more particularly relates to lubrication of internal engine components of a small, hand held four-stroke engine.

BACKGROUND OF THE INVENTION

Typically, outdoor power tools utilize a two-stroke internal combustion engine or an electric motor for powering an implement such as a line trimmer, a blower/vacuum or a chain saw. Two-stroke engines are relatively light and may readily be carried by an operator during operation with various angular orientations. However, two-stroke engines have well-recognized exhaust emissions problems that often make them unfeasible for their use in areas that must comply with exhaust gas emissions regulations such as the California Air Resource Board (CARB) and Federal EPA regulations dealing with air quality. Four-stroke internal combustion engines, on the other hand, provide a distinct advantage for outdoor power tool manufacturers in their attempt to meet the CARB and Federal EPA emissions regulations. In addition, four-stroke engines operate more quietly as compared to two-stroke engines.

Unlike two-stroke engines, which simultaneously admit a fresh charge of fuel and air mixed with lubrication oil while exhausting combustion products, including unburned fuel, a four-stroke internal combustion engine maintains the lubricating oil relatively isolated from a combustion chamber. Four-stroke engines are typically lubricated by oil from a separate oil reservoir, either in a crankcase, which is a pan attached to an underside portion of the engine, or in an external tank. An oil dipper is coupled to an end portion of a connecting rod and operates to splash oil from the oil reservoir onto various engine components for lubrication.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with a first aspect of the present invention, a four-stroke engine is provided which includes: a crankcase; an oil reservoir located within the crankcase; and means for vibrating the crankcase to mist oil from the oil reservoir to lubricate engine components.

In accordance with another aspect of the present invention, a four-stroke engine is provided which includes: a crankcase; an oil reservoir located within the crankcase; and means for misting oil from the oil reservoir without the use of an oil dipper.

To the accomplishment of the foregoing and related ends, the invention then, comprises the features hereinafter fully described. The following description and the annexed drawings set forth in detail certain illustrative aspects of the invention. These aspects are indicative, however, of but a few of the various ways in which the principles of the invention may be employed and the present invention is intended to include all such aspects and their equivalents. Other object, advantages and novel features of the invention will become apparent from the following detailed description of the invention when considered in conjunction with the drawings.

DETAILED DESCRIPTION OF THE INVENTION

Figure 1:
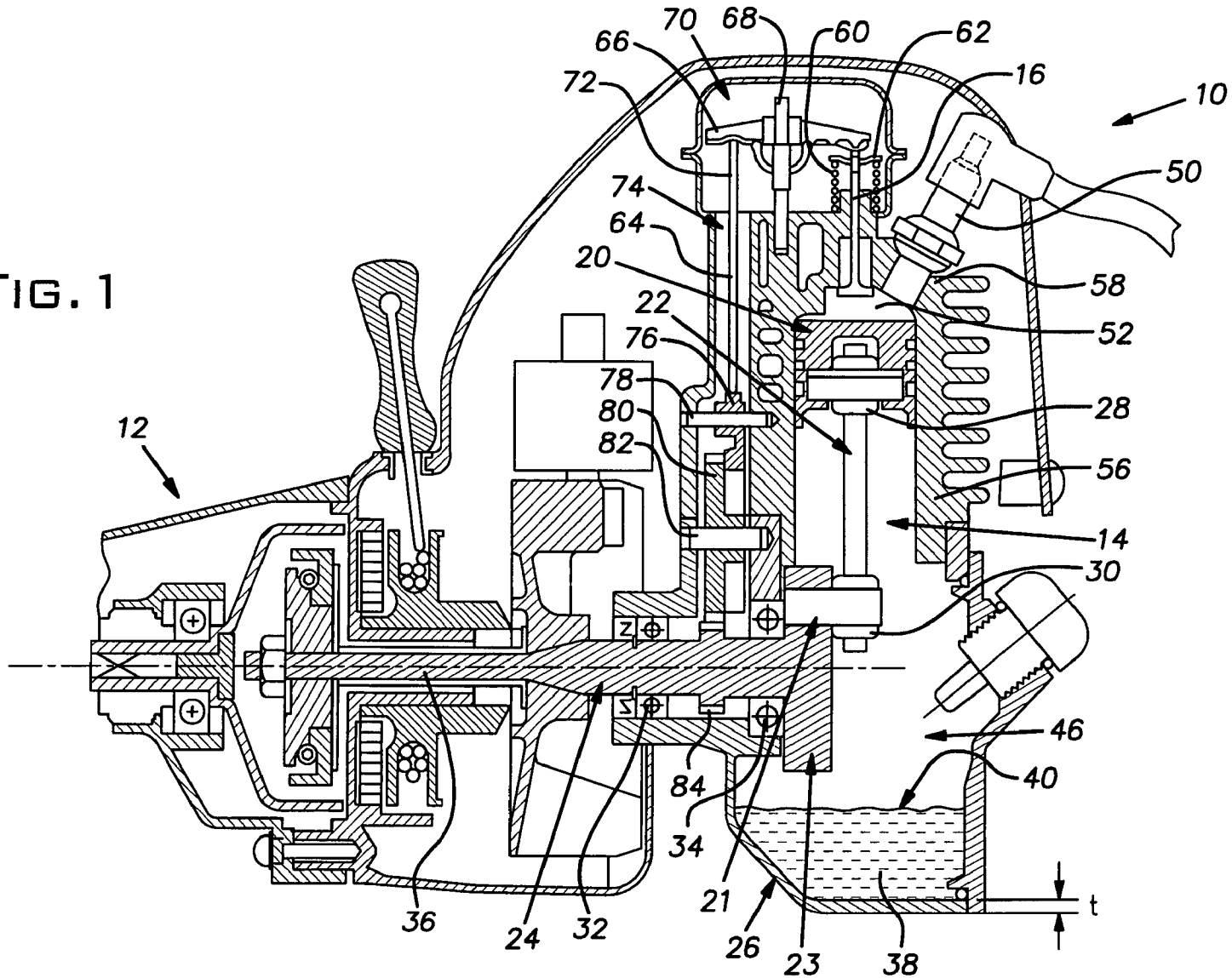
FIG. 1 illustrates a sectional front view of a four-stroke engine in accordance with a first aspect of the present invention.

The present invention provides systems for lubricating engine components of four-stroke engines. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details.

Figure 2:
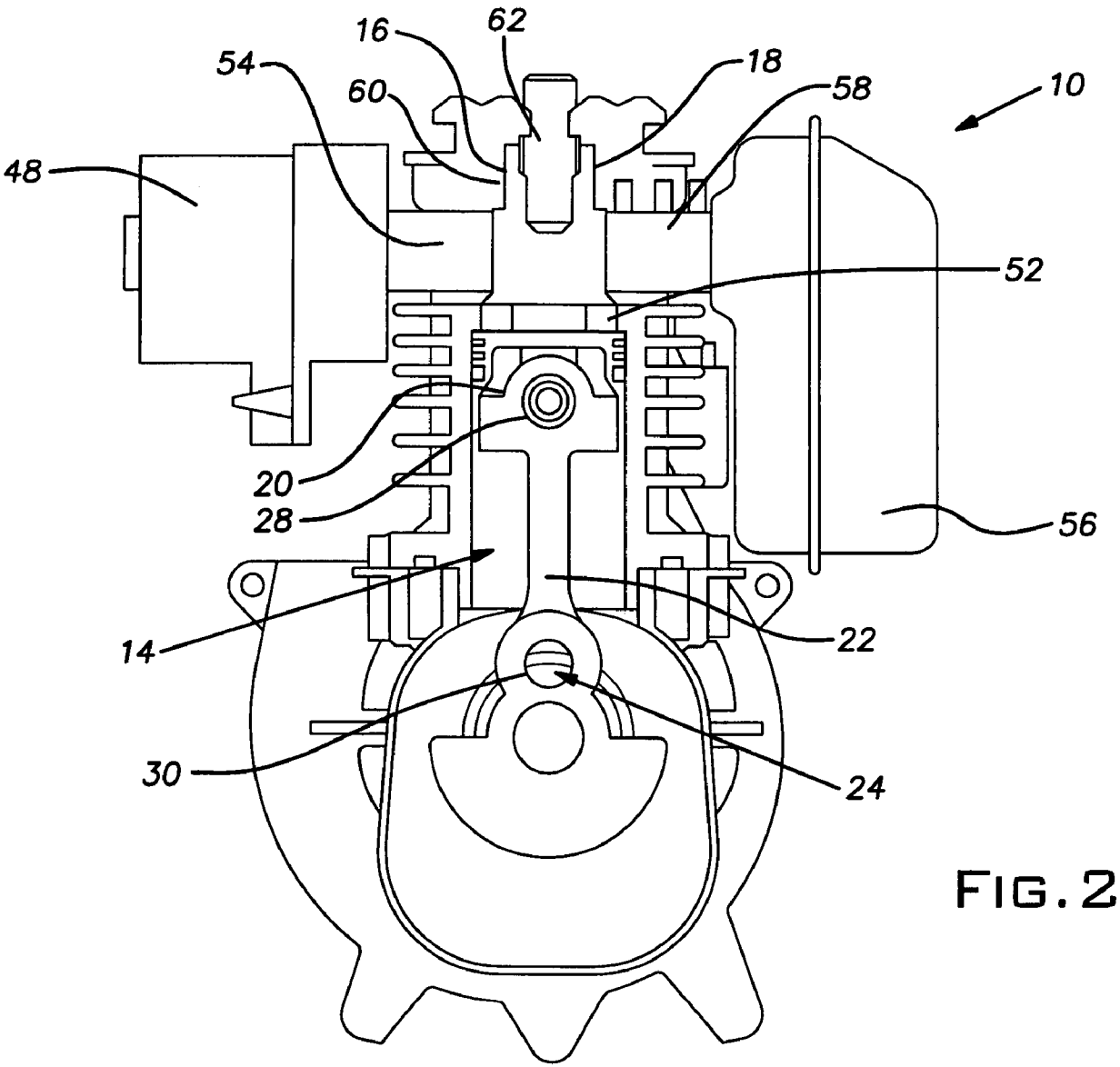
FIG. 2 illustrates a sectional side view of the four-stroke engine of FIG. 1.

Referring initially to FIGS. 1 and 2, sectional front and side views of a four-stroke engine 10 are illustrated in accordance with an aspect of the present invention. The four-stroke engine 10 can be employed in a handheld power tool 12, such as a trimmer. However, it is to be appreciated that the four-stroke engine 10 can be utilized in any other suitable application. The engine 10 includes cylinder 14, intake and exhaust valves 16 and 18, and a piston 20. The piston 20 is longitudinally movable in the cylinder 14 and is journalled so as to be pivotally movable via a crank pin 21 on a connecting rod 22. The crank pin 21 is held between two crank cheeks 23, which operate to balance a mass of the crank drive. The connecting rod 22 extends between and is operatively coupled to the piston 20 and a crankshaft 24 via first and second respective bearings 28 and 30. The crankshaft 22 is supported for rotation within a crankcase 26 via third and fourth bearings 32 and 34 and is operatively connected to a drive shaft 36, which delivers rotational force to a portion (e.g., a trimmer head drive shaft) of the power tool 12.

A bottom portion of the crankcase 26 forms an oil reservoir 38, which contains oil for lubricating components of the engine 10. In a conventional four-stroke engine, a big end of the connecting rod 22 is provided with an elongated oil dipper (not shown). The oil dipper moves in and out of the oil reservoir 38 to splash oil, which lubricates the engine components. However, the four-stroke engine 10 of the present invention mitigates the need for the oil dipper, thereby decreasing the number of components needed in constructing the four-stroke engine 10. To provide sufficient lubrication of the engine components without employing an oil dipper, engine vibration is employed to induce an oil ripple on a surface portion 40 of the oil. The oil ripple causes misting of the oil within the engine 10, which lubricates exposed engine components.

To increase vibration in the engine 10, a wall thickness (t) of the crankcase can be about 1.5 mm or less. Conventional crankcase wall thicknesses are about 2.5 mm. Thus, the present invention provides a crankcase 26 that has a wall at least 1.0 mm thinner than conventional crankcases. The thinness of the crankcase wall facilitates resonation and/or amplification of the engine's vibration source. The normal vibration of the engine is typically created by motion of the piston 20 and a counterweight (not shown). One or more counterweights can be associated with at least one of the crank cheeks 23 to balance the crank drive. The vibration produces a drum effect in the crankcase 26, which in turn, induces the oil surface 40 to ripple inside the crankcase 26. It is to be appreciated that the wall of the crankcase 26 can be manufactured to any thickness suitable to create sufficient lubrication for the engine components.

In accordance with another aspect of the present invention, a clearance area 46 located within the crankcase 26 can be decreased, as compared to conventional four-stroke engines. Generally, the clearance areas in conventional engines range from about 10 mm to 25 mm to create a space large enough for the oil sump and the oil dipper. However, because the engine 10 of the present invention does not employ an oil dipper, the clearance area 46 can be decreased to less than 10 mm. The decrease in area 46 facilitates contact of the oil ripple caused by vibration of the engine 10 with the counterweight, which produces splashing of the oil on the exposed engine components. As an example, the clearance area 46 can be about 1.5 mm.

During operation of the four-stroke engine 10, a carburetor 48 supplies a fuel mixture that is ignited by an igniter device 50 (e.g., spark plug) for combustion within a combustion chamber portion 52 of the cylinder 14. The ignition of the fuel mixture forces the piston 22 to move within the cylinder 14, which in turn causes the crankshaft 24 to rotate, as will be appreciated by the person of ordinary skill in the art.

An intake passage 54 extends from the carburetor 48, through a cylinder block 56 and/or cylinder head 58, toward the cylinder 14. The intake valve 16 is mounted in the cylinder head 58 and is in communication with the intake passage 54 and the combustion chamber portion 52 of the cylinder 14. The intake valve 16 is operable to open and permit flow of the fuel mixture into the combustion chamber portion 52 of the cylinder 14. For example, the intake valve 16 can be a poppet valve. A valve spring 60 can extend between a valve retainer 62, which is secured to the valve 16, and the cylinder head 58, or a spring seat (not shown) on the cylinder head, to bias the valve into a closed position. The exhaust valve 18 is provided and operatively connected similar to the intake valve 16. The exhaust valve 18 functions to vent combustion gases from the cylinder 14, as will be appreciated the person of ordinary skill in the art.

As discussed above for the shown example, the carburetor 48 provides the fuel mixture, and the fuel mixture passes through the intake passage 54, and through the open intake valve 16 into the combustion chamber portion 52 of the cylinder 16. However, it should be noted that different configurations for supplying the fuel mixture into the combustion chamber portion 52 of the cylinder 14 are possible and contemplated. For example, the carburetor 48 could be eliminated or modified, and gas and oil could be injected into the combustion chamber portion 52 of the cylinder 14, with air only being delivered via the intake valve 16. Such other fuel mixture deliver configurations are intended to be within the scope of the present invention.

Turning back to the shown example, the intake and exhaust valves 16 and 18 are each respectively connected to a valve drive train. Only the valve drive train 64 for the intake valve 16 is shown, but it is to be understood that similar structure exists for the exhaust valve 18. Within the drive train 48, a rocker arm 66 is pivotally coupled to a pivot mount 68 located within a valve chamber 70. One end of the rocker arm 66 is engaged with the valve 16 and is operable to move the valve (e.g., down as viewed in FIG. 1) and open the valve 16 against the bias of the spring 60.

A push rod 72 extends through a passage 74 in the cylinder block 56. The push rod 72 is in engagement with another end of the rocker arm 66 and is operable to push (e.g., upward as viewed in FIG. 1) and pivot the rocker arm 66. A cam follower 76 is located within the passage 74 within the cylinder block 56, and is in engagement with the push rod 72. The cam follower 76 is constrained for movement relative to the cylinder block 56 via a cam follower pin 78, and can transfer a movement force (e.g., in the upward direction as viewed in FIG. 1) to the push rod 72.

A cam gear 80 is located in the passage 74 within the cylinder block 56, and is supported for movement relative to the cylinder block 56 via a cam gear pin 82. The cam gear 80 is in engagement with the cam follower 76 and is in engagement with a crank gear 84 on the crankshaft 24. The cam gear 80 transfers force to the cam follower 76 in response to rotation of the crankshaft 24. It is to be appreciated that the drive train 64 may have a different construction, configuration, etc.

The drive train 64 is configured to cause operation of the intake valve 16 in a four-stroke engine sequence. Specifically, the timing of operation of the intake valve 16 is provided to be in the four-stroke engine sequence. The exhaust valve 18 (FIG. 2) is similarly operated in the four-stroke engine sequence.

The passage 74 (FIG. 1), though which the drive train 64 extends, connects the crankcase 24 with the valve chamber 70. The passage 74 permits fluid (e.g. gaseous) flow between the crankcase 24 and the valve chamber 70. Specifically, the passage 74 is sized to permit the fluid flow adjacent and past all of the components 66-84 in the drive train 64. A similar fluid flow exists for drive train components for the exhaust valve 18.

Figure 3:
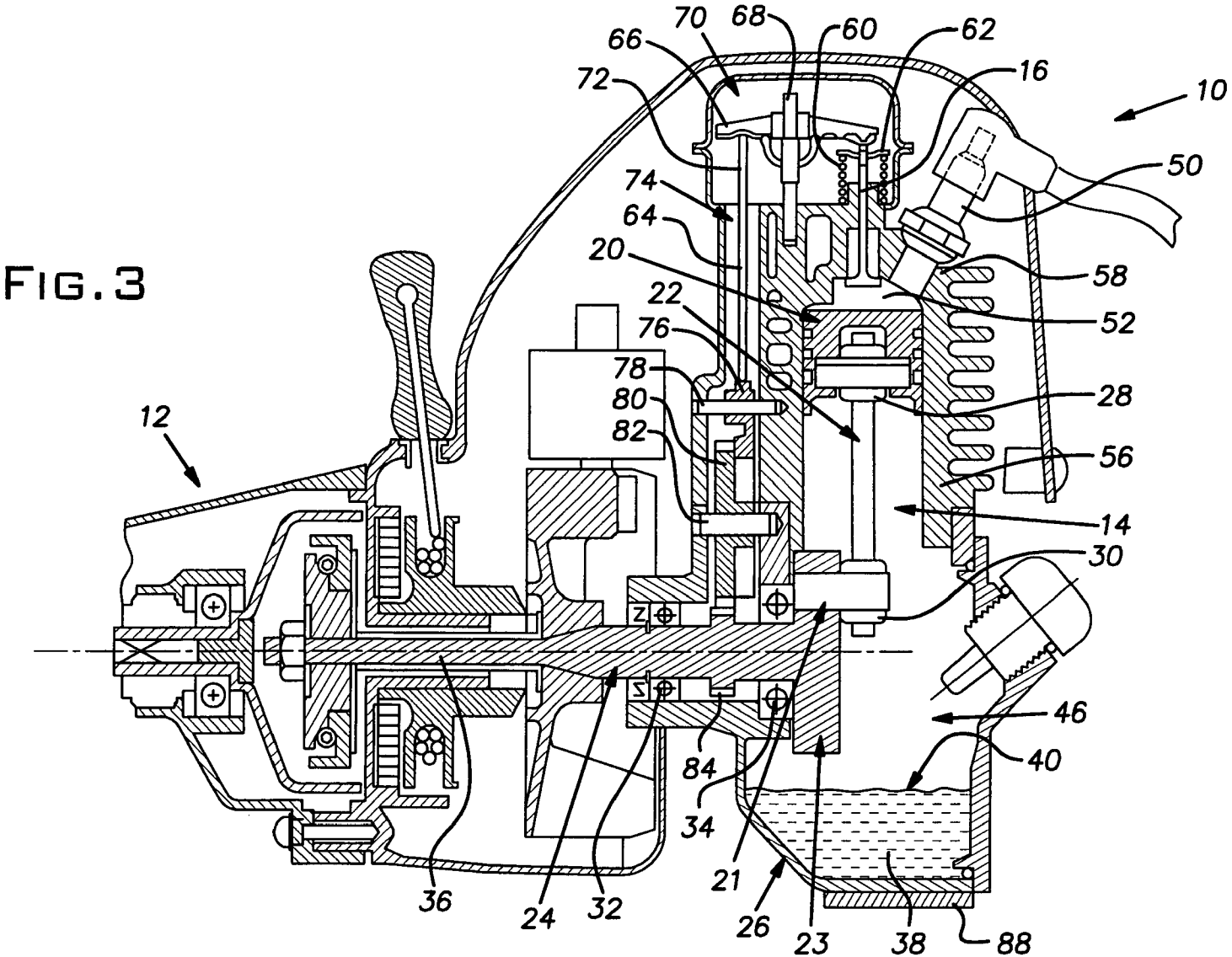
FIG. 3 illustrates a sectional front view of a four-stroke engine in accordance with a second aspect of the present invention.

Turning now to FIG. 3, another example of a four-stroke engine 86 is illustrated. In view of the similarity between the first and second embodiments, the parts or steps of the second embodiment that are substantially identical to the parts or steps of the first embodiment will be given the same reference numerals as the parts or steps of the first embodiment. Moreover, the descriptions of the parts or steps of the second embodiment that are identical to the parts or steps of the first embodiment are omitted for the sake of brevity.

The four-stroke engine 86 employs engine vibration to maintain engine lubrication. To amplify a natural vibration of the engine 86, a vibration mechanism 88 is coupled to a portion of the crankcase 26. The vibration mechanism 88 can be in the form of a vibration plate, a vibration spring, or any other suitable vibration structure. The vibration mechanism produces a drum effect in the crankcase 26, which in turn, induces an oil surface 40 to ripple inside the crankcase 26. The rippling of the oil surface 40 produces an oil mist within the engine 86 to lubricate the engine components. The vibration mechanism 88 can be employed with a crankcase 26 of any suitable wall thickness (t) and any suitable clearance area 46. Although the vibration mechanism 88 is depicted as being coupled to a bottom portion of the crankcase 26, it is to be appreciated that the vibration mechanism 88 can be coupled to any suitable portion of the crankcase 26.

The lubrication system of the present invention can be employed with any four-stroke engine. For example, the lubrication system can be employed in a four-stroke engine in which a cylinder and cylinder head is manufactured as a one-piece design to decrease the number of components needed for manufacturing the engine. As another example, the lubrication system can be employed in a four-stroke engine which utilizes a side valve.

As discussed herein, sufficient lubrication of the four-stroke engine can be accomplished via one or more constructions and/or configurations without employing the conventional oil dipper. The constructions and/or configurations utilize vibration of the engine and/or crankcase to induce a surface ripple in an oil reservoir, which facilitates misting and/or splashing of the oil. In the illustrations and corresponding descriptions, three separate constructions and/or configurations are provided. It is to be appreciated that only one of the constructions and/or configurations can be employed in a four-stroke engine; or two or more of the described constructions and/or configurations can be employed in a single four-stroke engine. Moreover, a construction and/or configuration different than the example constructions and/or configurations may be utilized alone or with one of the described constructions and/or configuration.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A four-stroke engine of comprising:

a crankcase;

a crankshaft supported for rotation within the crankcase;

an oil reservoir located within the crankcase; and means for vibrating the crankcase to mist oil from the oil reservoir to lubricate non-crankcase-environment engine components, wherein the means for vibrating the crankcase includes a vibration mechanism coupled to a portion of the crankcase;

wherein the means for vibrating the crankcase includes the crankcase having a wall thickness of about 1.5 mm.

2. A four-stroke engine of comprising:

a crankcase;

a crankshaft supported for rotation within the crankcase;

an oil reservoir located within the crankcase; and means for vibrating the crankcase to mist oil from the oil reservoir to lubricate non-crankcase-environment engine components, wherein the means for vibrating the crankcase includes a vibration mechanism coupled to a portion of the crankcase;

wherein the means for vibrating the crankcase includes the crankcase having a wall thickness of less than 1.5 mm.

3. A four-stroke engine of comprising:

a crankcase;

a crankshaft supported for rotation within the crankcase;

an oil reservoir located within the crankcase; and means for vibrating the crankcase to mist oil from the oil reservoir to lubricate non-crankcase-environment engine components, wherein the means for vibrating the crankcase includes a vibration mechanism coupled to a portion of the crankcase;

wherein the vibration mechanism is a vibration plate.

4. A four-stroke engine of comprising:

a crankcase;

a crankshaft supported for rotation within the crankcase;

an oil reservoir located within the crankcase; and means for vibrating the crankcase to mist oil from the oil reservoir to lubricate non-crankcase-environment engine components, wherein the means for vibrating the crankcase includes a vibration mechanism coupled to a portion of the crankcase;

wherein the vibration mechanism is a vibration spring.

5. A four-stroke engine of comprising:

a crankcase;

a crankshaft supported for rotation within the crankcase;

an oil reservoir located within the crankcase; and means for vibrating the crankcase to mist oil from the oil reservoir to lubricate non-crankcase-environment engine components, wherein the means for vibrating the crankcase includes a vibration mechanism coupled to a portion of the crankcase;

wherein the vibration mechanism is coupled to a bottom portion of the crankcase.

6. A four-stroke engine of comprising:

a crankcase;

a crankshaft supported for rotation within the crankcase;

an oil reservoir located within the crankcase; and means for vibrating the crankcase to mist oil from the oil reservoir to lubricate non-crankcase-environment engine components, wherein the means for vibrating the crankcase includes a vibration mechanism coupled to a portion of the crankcase;

wherein a clearance area located in the crankcase is less than 10 mm.

7. A four-stroke engine of comprising:

a crankcase;

a crankshaft supported for rotation within the crankcase;

an oil reservoir located within the crankcase; and means for vibrating the crankcase to mist oil from the oil reservoir to lubricate non-crankcase-environment engine components, wherein the means for vibrating the crankcase includes a vibration mechanism coupled to a portion of the crankcase;

wherein a clearance area located in the crankcase is about 1.5 mm.

8. A four-stroke engine of comprising:

a crankcase;

a crankshaft supported for rotation within the crankcase;

an oil reservoir located within the crankcase; and means for vibrating the crankcase to mist oil from the oil reservoir to lubricate non-crankcase-environment engine components, wherein the means for vibrating the crankcase includes a vibration mechanism coupled to a portion of the crankcase;

wherein a clearance area located in the crankcase facilitates splashing of the oil against a counterweight.

9. A four-stroke engine comprising:

a crankcase;

a crankshaft supported for rotation within the crankcase;

an oil reservoir located within the crankcase; and means for misting oil from the oil reservoir without the use of an oil dipper, wherein the means for misting oil includes providing a clearance area in the crankcase which is less than 10 mm such that a surface ripple in the oil reservoir splashes against a counterweight in the engine, the clearance area being maintained during a complete rotation of the crankshaft above an at-rest oil level.

10. The four-stroke engine of claim 9, wherein the clearance area is about 1.5 mm.

11. The four-stroke engine of claim 9, wherein the means for misting oil from the oil reservoir includes utilizing engine vibration to produce a ripple in a surface of the oil.

12. The four-stroke engine of claim 11, further comprising a vibration mechanism coupled to the crankcase to amplify the ripple.

13. A four-stroke engine of comprising:

a crankcase;

a crankshaft supported for rotation within the crankcase;

an oil reservoir located within the crankcase; and means for vibrating the crankcase to mist oil from the oil reservoir to lubricate non-crankcase-environment engine components, wherein the means for vibrating the crankcase includes a vibration mechanism coupled to a portion of the crankcase;

wherein the means for vibrating is coupled to an exterior portion of the crankcase.

14. A four-stroke engine comprising:

a crankcase;

a crankshaft supported for rotation within the crankcase;

an oil reservoir located within the crankcase;

means for misting oil from the oil reservoir without the use of an oil dipper, wherein the means for misting oil includes providing a clearance area in the crankcase which is less than 10 mm such that a surface ripple in the oil reservoir splashes against a counterweight in the engine, and wherein the means for misting oil from the oil reservoir includes utilizing engine vibration to produce a ripple in a surface of the oil; and a vibration mechanism coupled to the crankcase to amplify the ripple.

* * * * *